US007412201B2

(12) United States Patent
Wakabayashi et al.

(10) Patent No.: US 7,412,201 B2
(45) Date of Patent: Aug. 12, 2008

(54) POST-PROCESSING TRIMMING APPARATUS AND IMAGE-FORMING APPARATUS

(75) Inventors: Hiroyuki Wakabayashi, Hachioji (JP); Toshio Shida, Higashiyamato (JP); Masaaki Uchiyama, Hachioji (JP); Masato Hattori, Hino (JP); Norishige Kato, Hachioji (JP); Kenji Kawatsu, Machida (JP)

(73) Assignee: Konica Minolta Business Technologies, Inc. (JP)

( * ) Notice: Subject to any disclaimer, the term of this patent is extended or adjusted under 35 U.S.C. 154(b) by 291 days.

(21) Appl. No.: 11/042,983

(22) Filed: Jan. 25, 2005

(65) Prior Publication Data

US 2005/0274252 A1 Dec. 15, 2005

(30) Foreign Application Priority Data

Jun. 10, 2004 (JP) ..... 2004-172307

(51) Int. Cl.
*G03G 15/00* (2006.01)

(52) U.S. Cl. ..... 399/407; 399/408; 399/410

(58) Field of Classification Search ..... 399/407, 399/408, 410, 385; *B65H 037/06*
See application file for complete search history.

(56) References Cited

U.S. PATENT DOCUMENTS 4,891,681 A * 1/1990 Fiske et al. ..... 399/385
6,799,759 B1 * 10/2004 McNamara et al. ..... 270/58.08
2002/0021924 A1 * 2/2002 Mimura et al. ..... 399/407

FOREIGN PATENT DOCUMENTS

JP 2000-198613 7/2000
JP 2000211806 A * 8/2000

* cited by examiner

*Primary Examiner*—Ren Yan
*Assistant Examiner*—Matthew G Marini
(74) *Attorney, Agent, or Firm*—Cantor Colburn LLP

(57) ABSTRACT

A post-processing apparatus which has a trimming apparatus for trimming an edge of sheets to make booklets, wherein the trimming apparatus has an inserting means for insertion of sheets into trimming process section of the trimming apparatus, an edge sustaining member and an edge holding member for pinching the vicinity of the edge of the sheet during the trimming process and a shifting means to make the opening size variable for receiving sheets by changing the relative position between the edge holding member and the edge sustaining member and a controller for controlling the shifting means to change the opening size between the edge holding member and the edge sustaining member according to the number of the sheets to be trimmed.

6 Claims, 10 Drawing Sheets

FIG. 6 ( a )
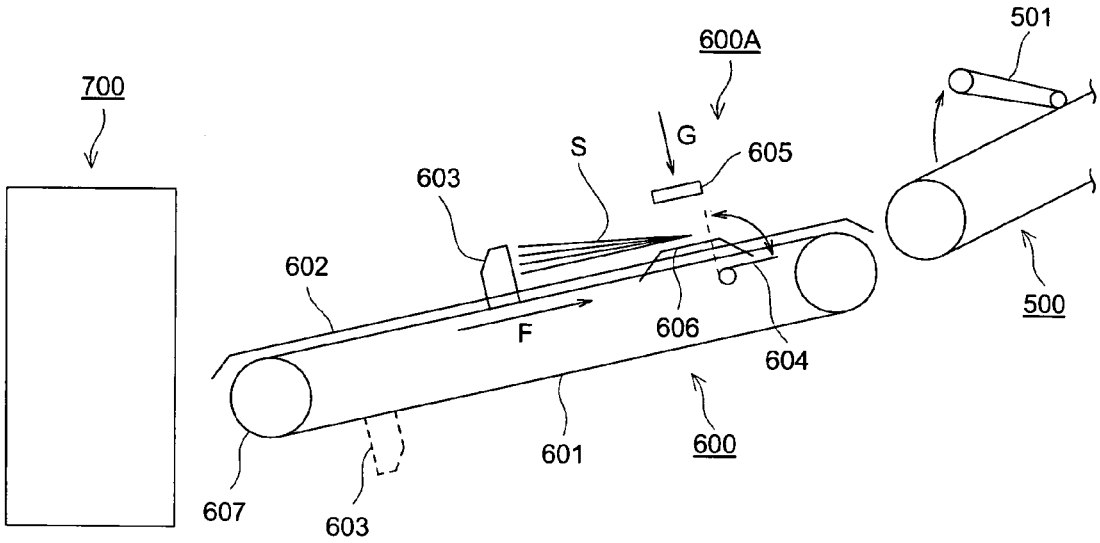
FIG. 6 ( b )
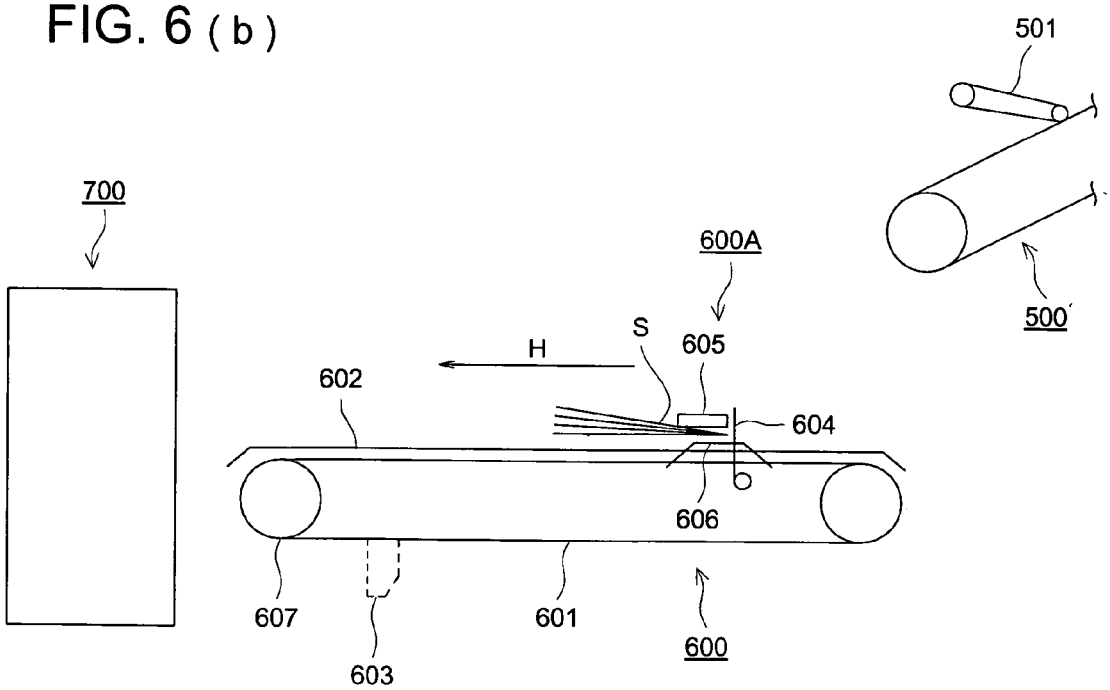

POST-PROCESSING TRIMMING APPARATUS AND IMAGE-FORMING APPARATUS

BACKGROUND OF THE INVENTION

The present invention relates to a post-processing apparatus which makes booklets by trimming an edge of sheets, and an image-forming apparatus equipped with the post-processing apparatus.

There has been used in the printing industry, a post-processing apparatus equipped with a trimming apparatus for aligning an edge by trimming the edge of sheets of paper after some processes such as a center-folding process and a saddle-stitching process of the sheets.

Lately, there has been provided a post-processing apparatus equipped with a trimming apparatus for aligning an edge by trimming the edge of sheets of paper, to which processes such as a center-folding process and a saddle-stitching process of the sheets have been carried out after receiving sheets on which images were formed by image-forming apparatuses such as a copying machine and a printer.

Apparatuses described below are known as a trimming apparatus mentioned above.

FIG. 11 shows a cross-sectional view of the main parts of trimming apparatus 900 which trims an edge of sheets S to which a center-folding and a saddle-stitching have been carried out.

The numeral 901 represents an upper blade which moves vertically and trims uneven edges of sheets S in cooperation with a lower blade 902 which is fixed to the body.

The numeral 903 represents an edge holding member which holds a portion of the sheets S near the edge, and is urged by spring 904 in conjunction with a lowering motion of the upper blade 901 so as to hold the portion of the sheets S to prevent the sheets S from sliding.

The numeral 905 represents a fold-holding means to eliminate a swell of the sheets around the fold.

The numeral 906 represents a stopper to stop sheets S fed to the trimming position by inserting means 907 and 908 at the prescribed position.

By means of the above-mentioned structure, the sheets S are inserted into the trimming position by inserting means 907 and 908, and fold-holding means 905 lowers to eliminate a swell of the sheets around the fold when the sheets contact the stopper 906 and stop there.

Subsequently, upper blade 901 trims uneven edges of the sheets S in cooperation with lower blade 902, after the upper blade 901 lowers and a portion of sheets near the edge is held by edge holding member 903.

Post-processing apparatuses equipped with trimming apparatuses of this kind have been disclosed (for example, refer to Patent Document 1).

[Patent Document 1] TOKKAI 2000-198613

The number of sheets on which an edge trimming is carried out is extensive from a small number (for example, about five before being folded) to a large number (for example, about fifty before being folded) and a large force is necessary for pressing edge holding member 903 to prevent the sheets from sliding during the trimming because a large force is necessary to cut sheets when a large number of sheets are trimmed.

However, according to the structure described in Patent Document 1, there are cases, in which the trimmed face is not even, caused by sliding of sheets when a large number of sheets are treated, because a portion of sheets near the edge is held by force of spring 904.

For preventing this problem, there is an idea to move edge holding member 903 by a driving means independent from one for upper blade 901.

In this case, although increase of power of the driving motor used for driving means can be considered to increase pressing force of edge holding member 903, it is not expedient because of an increase of electricity consumption, upsizing of the body and a raise in cost increase.

Accordingly, it is preferable to use a motor as small as possible and to obtain demanded pressing force for edge holding member 903, through gear reduction.

When the ratio of the gear reduction is large, the traveling speed of the edge holding member 903 is lowered and it causes a problem that it takes long to hold the sheets S, and therefore, the traveling time of edge holding member 903 may become longer than the process time of the upstream side of the post-processing apparatus or the process time of the image-forming apparatus, leading to the decline of productivity when the number of the sheets is small.

SUMMARY OF THE INVENTION

The present invention has been achieved in view of problems mentioned above and an object of the invention is to provide a post-processing apparatus and an image-forming apparatus equipped with the post-processing apparatus which can prevent reduction of productivity regardless of the number of sheets by shortening the time necessary to hold a portion of sheets near the edge before the trimming process when an edge of sheets is trimmed.

The object of the present invention can be accomplished by structures described below.

A post-processing apparatus equipped with a trimming apparatus, which carries out a trimming process on an edge of a bundle of sheets, comprises a controller which controls a shifting mechanism to change the opening size depending on the number of sheets composing a bundle of sheets to be trimmed.

BRIEF DESCRIPTION OF THE DRAWINGS

FIG. 6 is a schematic diagram of trimming conveyor 600 and a conveying mechanism for sheets S.

DETAILED DESCRIPTION OF THE PREFERRED EMBODIMENT

An example of embodiment of a post-processing apparatus related to the invention will be explained as follows referring to drawings.

The post-processing apparatus of the embodiment of the invention is connected to an image-forming apparatus.

Figure 1:
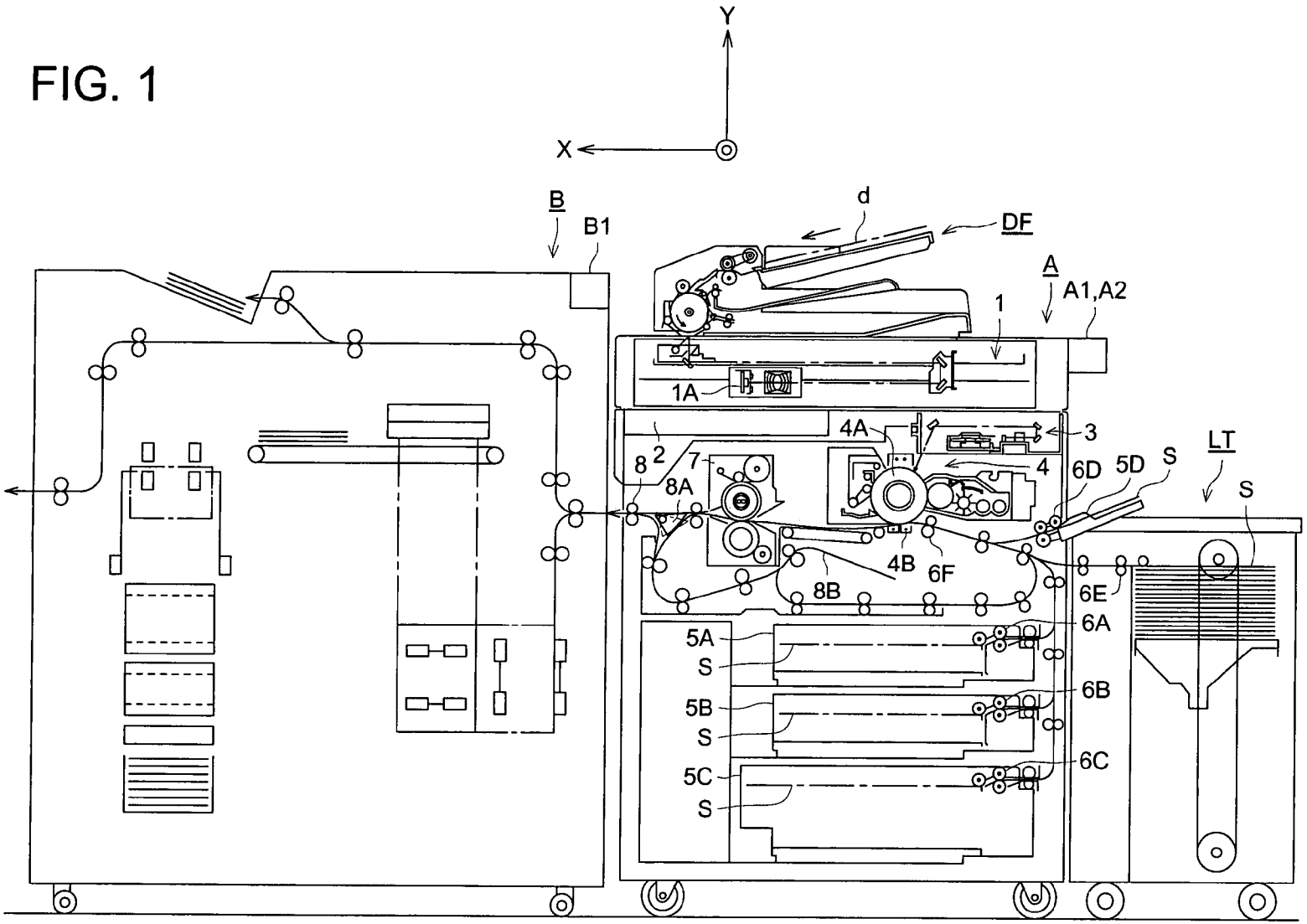
FIG. 1 is a general structural view of image-forming apparatus equipped with a post-processing apparatus.

FIG. 1 shows a general diagram of the structure of an image-forming apparatus and a post-processing apparatus.

Symbol A indicates an image-forming apparatus, DF indicates an automatic document feeder, LT indicates a large-capacity paper feeder and B indicates a post-processing apparatus.

The image-forming apparatus A includes image-reading portion (image input device) 1, image-processing portion 2, image-writing portion 3, image-forming portion 4, paper-feed cassettes 5A, 5B, 5C, manual paper-feed tray 5D, first paper feeders 6A, 6B, 6C, 6D, 6E, registration roller 6F, fixing unit 7, paper discharge portion 8 and automatic duplex copy paper feeder (ADU) 8B.

Automatic document feeder DF is mounted on the upper part of the image-forming apparatus A and post-processing apparatus B is connected to the image-forming apparatus solidly as shown in the left side of the diagram.

A1, A2 and B1 indicate an image-forming apparatus controller, an operating portion and a post-processing apparatus controller respectively.

An original document d set on a document tray of automatic document feeder DF is conveyed in the direction of the arrow and an image on one side or images on both sides of the document is read by CCD image sensor 1A of an optical system in the image-reading portion 1.

Analog signals which have been photoelectrically transduced by the CCD image sensor 1A are, analog-processed, A/D converted, processed with shading correction and image-compressed in image-processing portion 2 and then sent to the image-writing portion 3 as image information signals.

Image-forming portion 4 is a portion forming images with electrophotographic process, wherein processes such as charging, exposing, developing, transferring, separating and cleaning are carried out on photoreceptor drum 4A. Ray of light from a semiconductor laser (not illustrated) based on an image information signal is irradiated to a photoreceptor drum 4A and an electrostatic latent image is formed in the process of exposure. Besides, a toner image corresponding to the electrostatic latent image is formed in the process of development.

When one of the feeders among paper feed cassettes from 5A through 5C, manual paper feed tray 5D and large-capacity paper feeder LT is selected together with the corresponding first paper feeder among 6A through 6E, a sheet of paper S is conveyed toward registration roller 6F. The sheet of paper is synchronized with a toner image on photoreceptor drum 4A by the registration roller 6F to be conveyed toward transfer portion 4B so that the toner image is transferred on it.

The sheet of paper S carrying a toner image is fed from paper discharge portion 8 to post-processing apparatus B after the toner image is fixed by fixing unit 7.

When the automatic duplex copy is selected, a sheet of paper wherein an image is formed on one side of the sheet is fed to automatic duplex copy paper feeder 8B by switching of conveying passage switching plate 8A, so that another image forming is carried out on the other side of the sheet in image-forming portion 4, and fed to post-processing apparatus B from paper discharge portion 8 after toner is fixed in fixing unit 7.

Next, an explanation will be given regarding outline of the post-processing apparatus B referring to FIG. 2, FIG. 3, FIG. 4 and FIG. 5.

Figure 2:
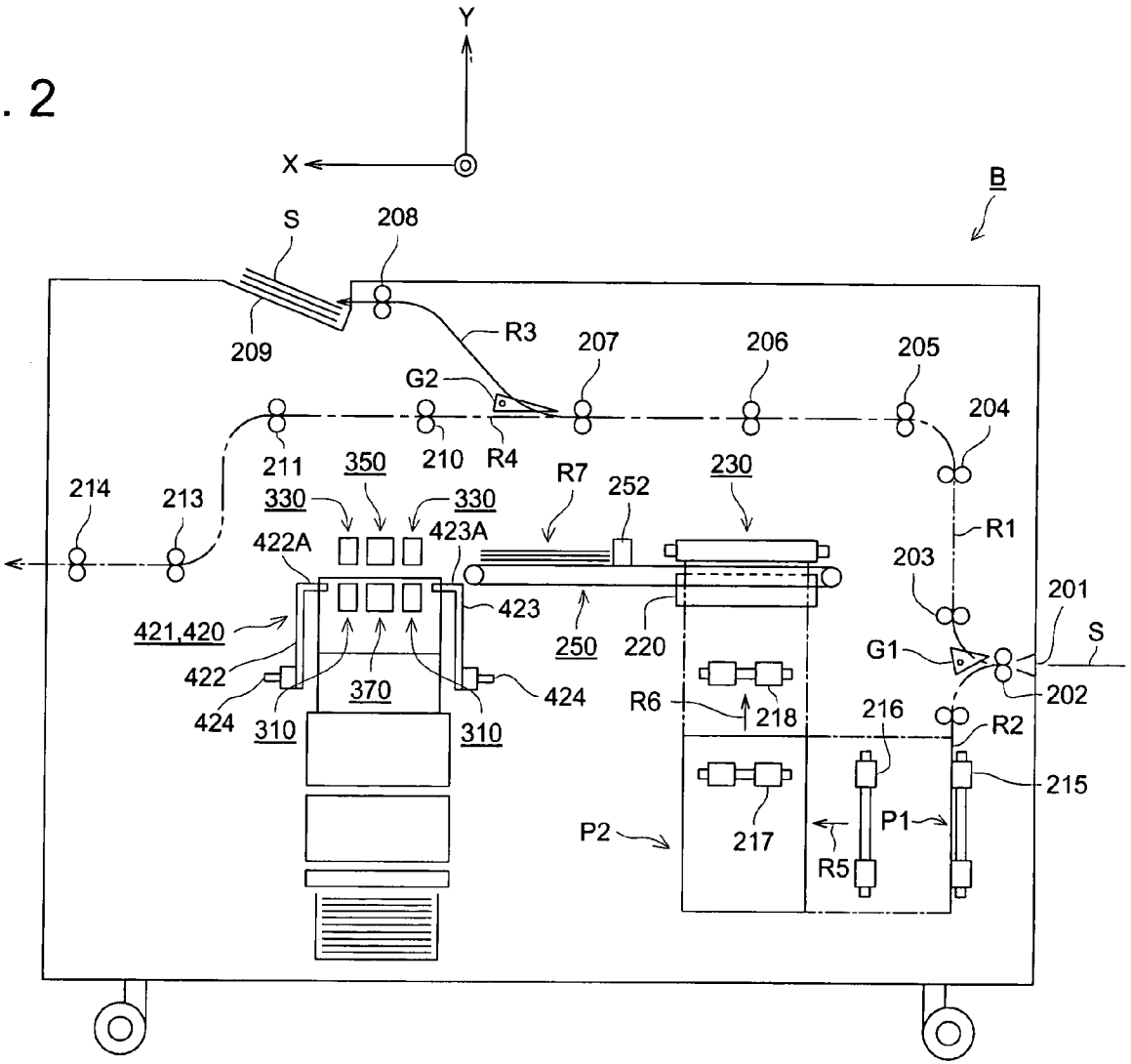
FIG. 2 is a schematic front view of a post-processing apparatus.
Figure 3:
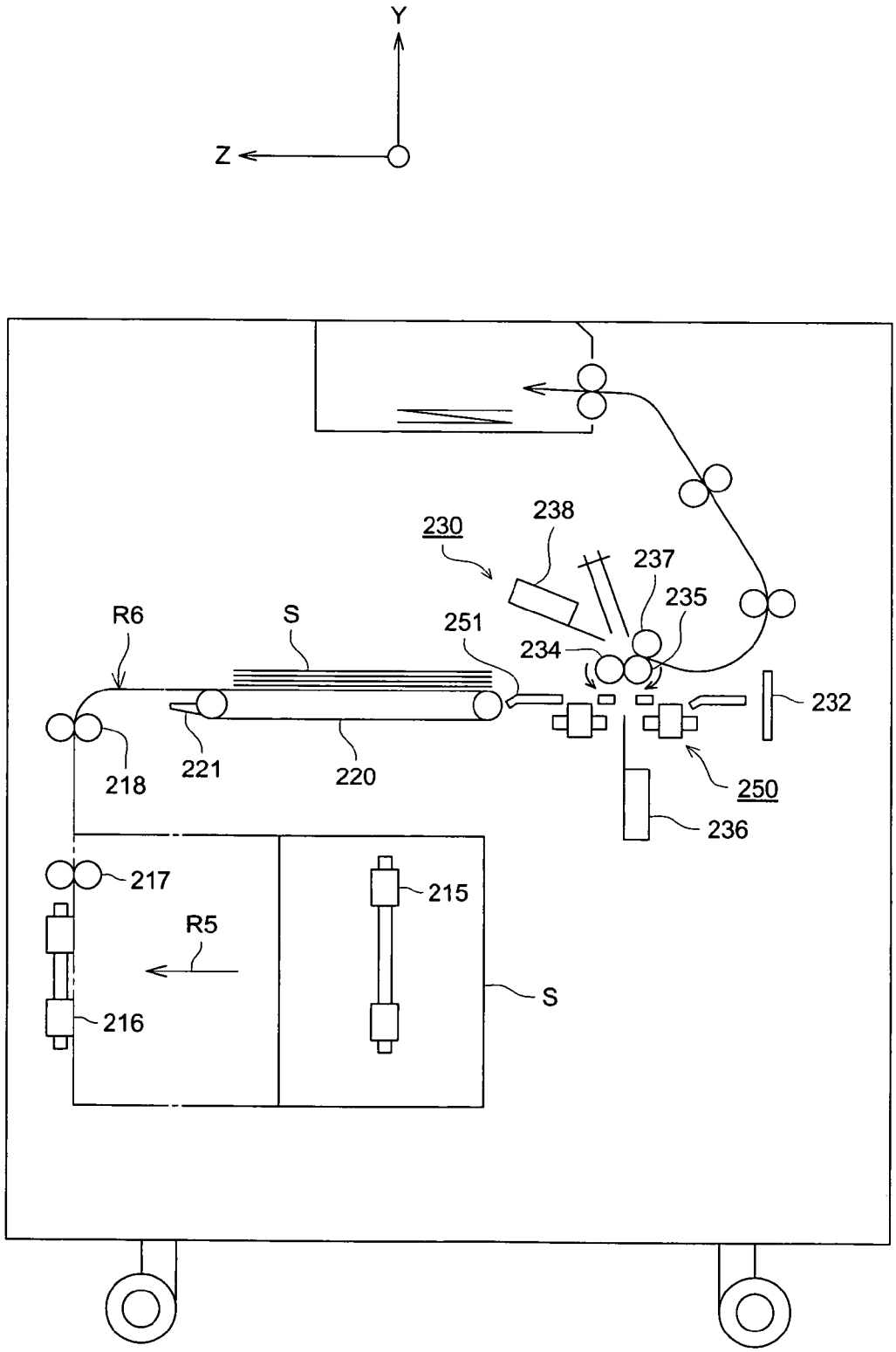
FIG. 3 is a right side view of a post-processing apparatus in FIG. 2.
Figure 4:
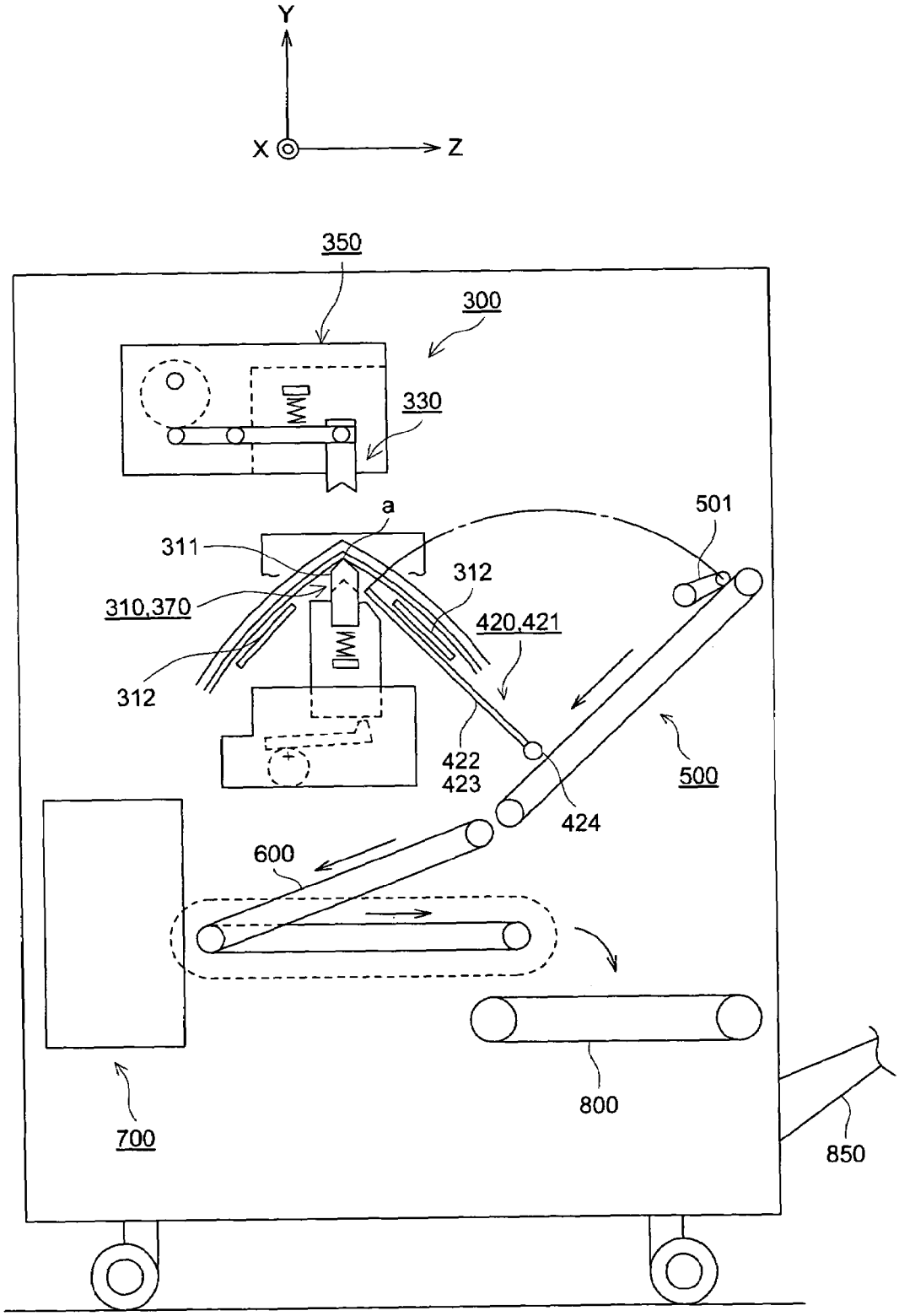
FIG. 4 is a left side view of a post-processing apparatus in FIG. 2.
Figure 5:
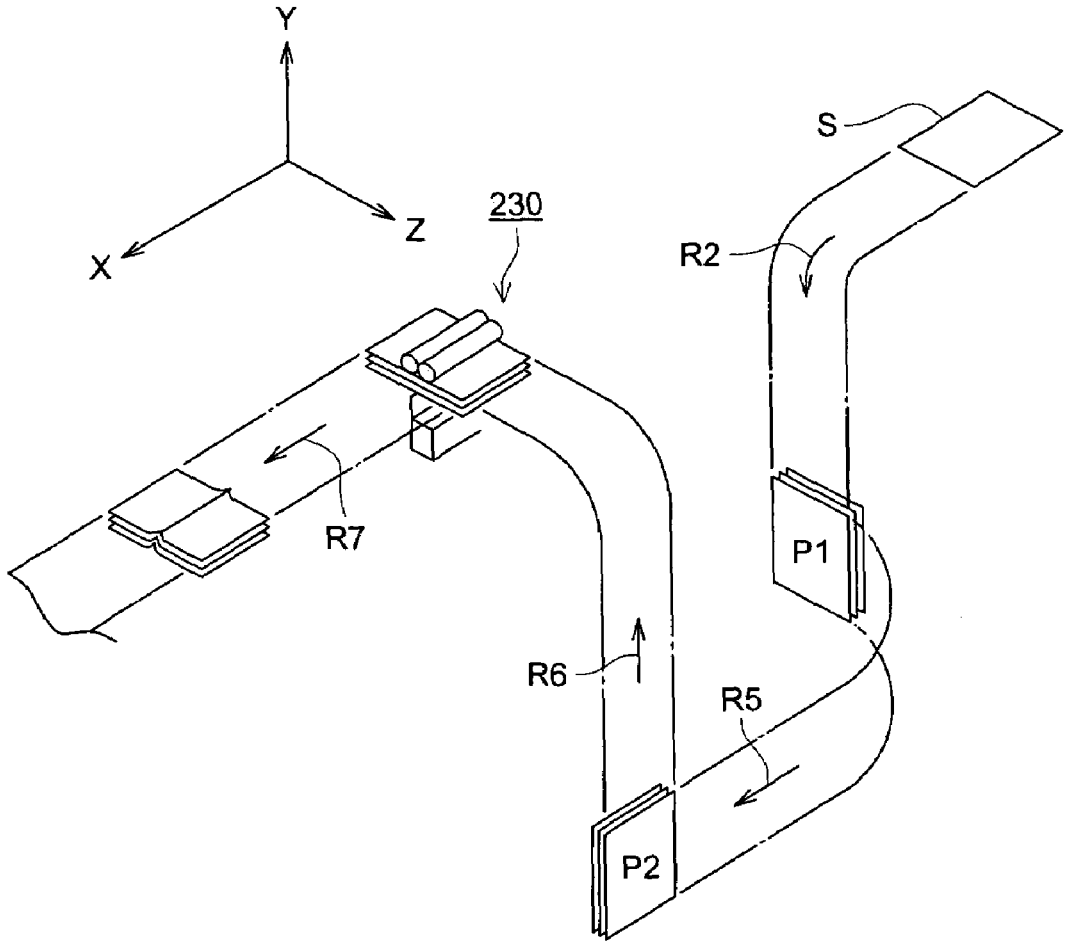
FIG. 5 is a schematic diagram showing a part of flow of sheets in a post-processing apparatus.

FIG. 2 is a front view of a post-processing apparatus, FIG. 3 is a right side view of it, FIG. 4 is a left side view of it and FIG. 5 is a schematic diagram showing a part of a sheet flow in the post-processing apparatus.

In each of the above-mentioned views, arrows X, Y and Z represent axes of rectangular coordinates indicating directions, and positive directions of coordinates are named X direction, Y direction and Z direction and negative directions are named reverse X direction, reverse Y direction and reverse Z direction respectively.

Regarding the directions perpendicular to the sheet of paper, when the arrow points toward the surface of the sheet, it is described by ◎, and when the arrow points toward the back of the sheet, it is described by ○.

The sheet of paper S on which an image is formed by an image-forming apparatus is conveyed to either the conveying passage through which the sheet is delivered without being processed or the conveying passage in which center-folding and saddle-stitching are processed on the sheet.

The sheets S fed to the conveying passage for center-folding and saddle-stitching are subjected to center-folding after plural sheets are piled, and then loaded on an inverted V-shaped loading means. After the number of the sheets piled reaches the prescribed one, saddle-stitching is conducted and then the sheets are unloaded by an unloading means and discharged after trimming of the edge by the trimming apparatus.

Firstly, an explanation will be given regarding a conveying route of sheet S which has entered conveying passage R1 referring to FIG. 2.

Sheet S fed to conveying passage R1 by passage-switching means G1 is pinched and conveyed by conveying rollers 203 through 207 to be fed to either conveying passage R3 on the upper side of conveying-passage switching means G2 or conveying passage R4 on the lower side thereof.

The sheet S fed to the upper conveying passage R3 is delivered by paper-discharge roller 208 to the sub-discharge tray (top tray) 209 located on the upper portion of post-processing apparatus B.

The sheet S fed to the lower conveying passage R4 is pinched and conveyed by conveying rollers 210 through 213 and fed to another post-processing apparatus by paper-discharge roller 214.

Next, an explanation will be given regarding conveyance of sheet S which has entered conveying passage R2, referring to FIG. 2 and FIG. 5.

The sheet S fed to conveying passage R2 by conveying-passage switching means G1 is conveyed in the reverse Y direction and stays to be stored temporarily at the prescribed position (position P1 indicated in the diagram).

A small amount of subsequent sheets S are piled additionally to be stored at the position P1.

Although the number of stored sheets stated above according to the embodiment is three, the number is not limited to this and can be set properly.

The stored three sheets S at the position P1 are conveyed in the piled state in the Z direction by conveying rollers 215, 216 and guide plates (not illustrated), and then are turned to be deviated in the X direction and stop temporarily at the position P2 (conveying passage R5).

In the following explanation, three (or plural) sheets S are simply represented by sheets S, unless otherwise provided.

The sheets S staying at the position P2 temporarily are conveyed in the Y direction according to a prescribed timing by conveying rollers 217, 218 and guide plates, and then are deviated in the reverse Z direction (conveying passage R6).

The sheets S deviated in the reverse Z direction are fed to center-folding means 230 by conveyance-registering belt 220.

Here, an explanation is given regarding the center-folding portion 230 referring to FIG. 3.

The means according to the embodiment is structured so that the lengthwise direction of the sheets S may agree with the direction of conveyance of conveyance-registering belt 220.

The center-folding portion 230 includes registering member 232, center-folding rollers 234, 235 and center-folding knife 236.

Registering plate 232 is located so that the distance between the registering plate and the contacting point of center-folding rollers 234 and 235 is equivalent to a half length of the sheet S in the lengthwise direction of the sheet.

Sheets S conveyed in the reverse Z direction are pushed by registering claw 221 mounted on conveyance-registering belt 220 and conveyed on guide plate 251 which composes center-folding sheet conveying means 250, which will be described later, until the sheets stop at the position where the leading edges of the sheets S hit registering member 232.

Subsequently, registering claw 221 is moved back and forth by a reciprocal rotation of conveyance-registering belt 220, and the trailing edges of the sheets S (three sheets) are pressed and the sheets S are aligned in terms of width in the direction of the conveyance.

After completion of the aligning operation described above, center-folding knife 236 mounted at the lower position of the contacting point of center-folding rollers 234 and 235 pushes up the sheets S on guide plate 251 at the middle portion in the lengthwise direction of the sheets S to make the sheets to be pinched by center-folding rollers 234 and 235 rotating in the directions of arrows shown in the diagram.

After the pinched sheets S are given a fold at the middle portion in the lengthwise direction of the sheets by center-folding rollers 234 and 235, the sheets are fed back onto the guide plate 251 by reverse rotation of center-folding rollers 234 and 235 and transported in the direction of X by center-folded sheet conveying means 250 which will be described later.

The means is composed wherein, when the size of the sheet is changed, the position of registering plate 232 and the operation of registering belt 220 and so on can be changed according to the size of the sheet by a controller which is not illustrated.

It is also possible to apply Z shaped folding (tri-folding) to sheet S by using roller 237 and folding knife 238.

Back to FIGS. 2 and 5, sheets S given a fold at the middle portion in the lengthwise direction of the sheets are conveyed in the X direction by conveying claw 252 fixed on conveying belt of center-folded sheet conveying means 250 and guide plates which are not illustrated, and loaded on loading means 310 (conveying passage R7).

Next, an explanation will be given regarding loading means 310, stapler 350 and staple receiving means 370 which constitute saddle-stitching means, referring to FIG. 4.

The loading means 310 includes fold-supporting member 311 which is inverted V-shaped and side edge supporting members 312 which are also inverted V-shaped, and the fold-supporting member 311 supports the vicinity of fold "a" on the valley side (lower side) of the creased sheets S and side edge supporting members 312 supports the valley side of side edge portions of the creased sheets S.

The valley side surface of creased sheets S represents the inner surfaces facing each other when the sheets are folded along the fold and a hill side surface represents the outer surfaces of the sheets.

Holding means 330 which is vertically movable and stapling means 350 which is fixed to the body are placed above the loading means 310.

Staple receiving means 370 which is vertically movable is placed below the fold "a" of the loaded sheets S.

A pair of stapling means 350 and a pair of staple receiving means 370 both of which are parts of sheet-stitching means are placed at two positions equally divided on both sides when viewed in the lengthwise direction of the fold.

By means of the structure described above, when the number of the sheets S loaded on the loading means 310 reaches the prescribed one, holding means 330 lowers and staple receiving means 370 rises while the holding means is holding the sheets S and then staples are shot to two portions on the fold of the sheet S by stapling means 350.

In explanations below, although plural sheets S stitched together should be called a bundle of sheets or a booklet to be discriminated, they will continue to be called sheets S for simplification.

An explanation will be given regarding how to unload saddle-stitched sheets S referring to FIG. 2 and FIG. 4.

Unloading means 420 for unloading sheets S includes supporting means 421 and a driving means (no reference symbol).

Supporting means 421 includes supporting members 422 and 423 which are located on the both ends of the sheets S loaded on the loading means 310 and the supporting members 422 and 423 are structured by bar members having bent parts 422A and 423A respectively where they are bent at right angle at the ends to support a fold part of the sheets S.

The other ends of supporting members 422 and 423 are supported rotatably around supporting stem 424.

The supporting members 422 and 423 are structured on right and left in FIG. 2 so that they can be inserted in and parted from the fold part of the sheets S in order to support the loaded sheets S by the driving means.

The supporting members 422 and 423 are swung by the driving means with supporting stem 424 centered, between the unloading position for the sheets S placed on the loading means 310 and the delivering position for the sheets S to be delivered to receiving conveyor 500 as shown in FIG. 4.

By means of this structure, when the number of the sheets S loaded on the loading means 310 reaches the prescribed one and saddle-stitching process is completed by saddle-stitching means, the supporting means 422 and 423 are inserted in space near the fold of the loaded sheets, and support the sheets S at the fold part, and then, swing from the unloading position to the delivering position so that the sheets S are loaded on the receiving conveyor 500 and the loaded sheets S are pinched by grip 501.

The sheets S pinched by grip 501 are conveyed downward obliquely, according to the rotation of the receiving conveyor 500 and delivered to trimming conveyor 600 after released from grip 501.

The trimming conveyor 600 is leveled down after the delivery of the sheets S, and subsequently, the sheets S are conveyed toward trimming process section 700 with the fold part being held by a fold-holding member which will be described later and uneven edges (free edge on the opposite side of a fold) are trimmed by trimming device 700, after the sheets are stopped at the prescribed position.

After the trimming process is completed, the sheets S are conveyed in the reverse direction by trimming conveyor 600 and dropped from the end of trimming conveyor 600 in the direction of the arrow to be collected by collecting conveyor 800 and to be discharged to paper discharge tray 850 located on the outside of the front face of post-processing apparatus B.

Next, a detailed explanation will be given regarding trimming apparatus 700, referring to FIG. 6 through FIG. 8.

FIG. 6 shows a schematic diagram of trimming conveyor 600 and conveying mechanism for sheets S.

Figure 7:
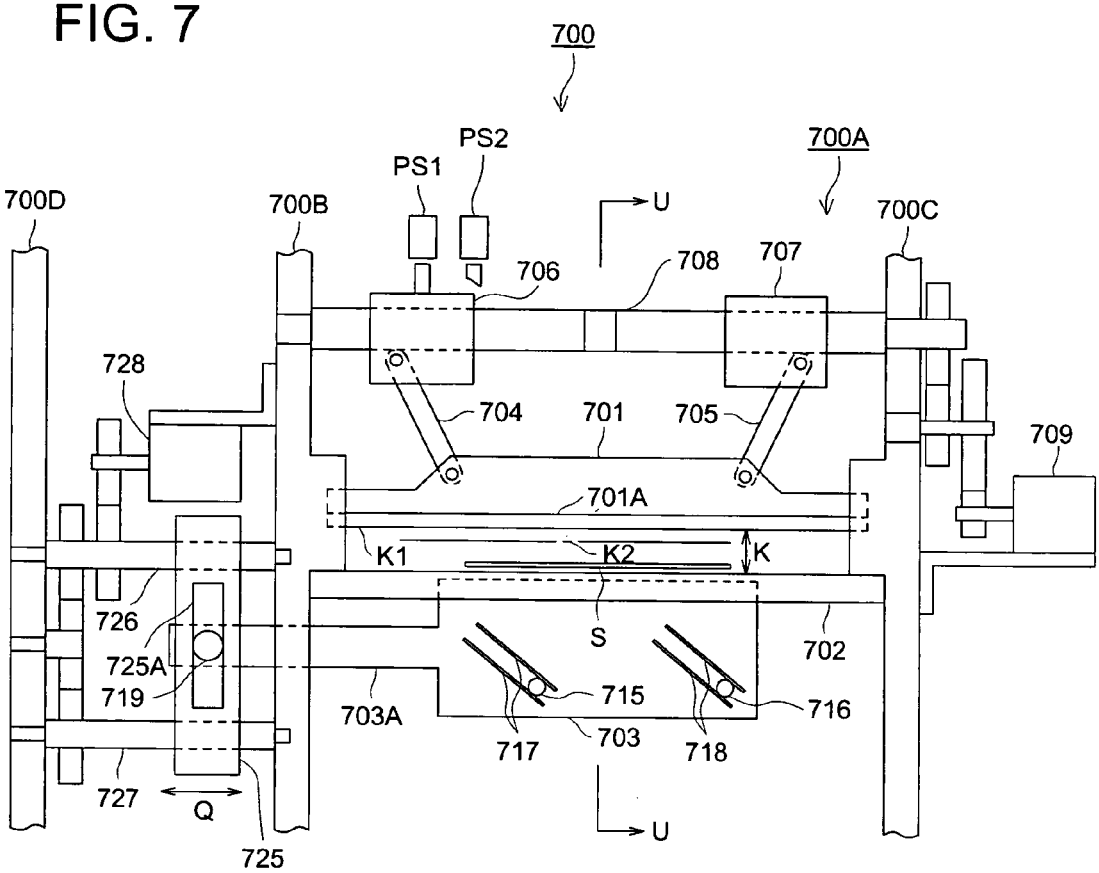
FIG. 7 is a schematic front view of trimming apparatus 700 viewed from the direction of insertion of sheets into the trimming apparatus 700.
Figure 8:
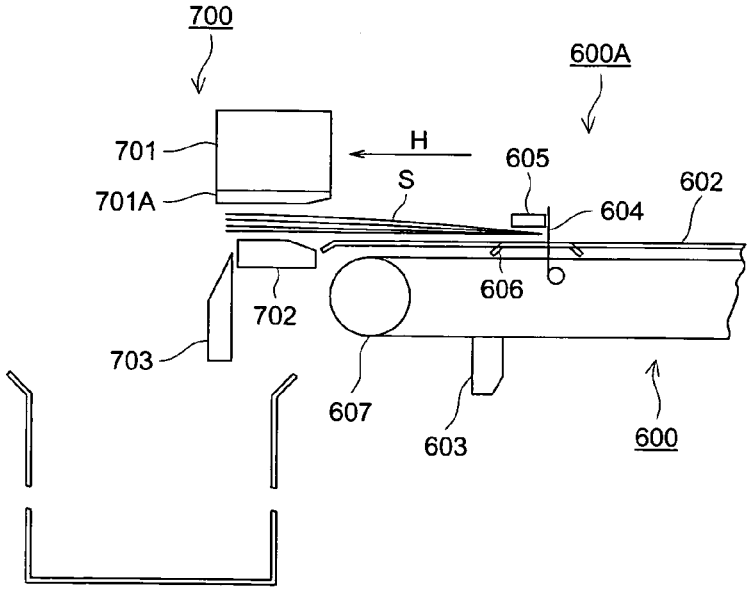
FIG. 8 is a cross-sectional view of main parts taken on line U-U in FIG. 7.

FIG. 7 shows a schematic front view of trimming apparatus 700 viewed in the direction for inserting sheets in the trimming apparatus 700, and FIG. 8 shows a cross-sectional view of main parts taken on line U-U in FIG. 7.

Firstly, an explanation will be given referring to FIG. 6 regarding a mechanism, wherein center-folded and saddle-stitched sheets S are delivered from receiving conveyor 500 to trimming conveyor 600 and stopped at the prescribed position after the delivery, for an edge trimming by trimming apparatus 700.

Grip 501 opens and releases sheets S which were pinched by the grip, near the end of downstream side of receiving conveyor 500 in the paper conveying direction, as shown in FIG. 6(*a*).

The released sheets S slide on a slant surface of paper loading table 602 provided to be close to and parallel to the upper part of the conveying belt 601 of inclined and stopped trimming conveyor 600, and stop after hitting stopper claw 603 fixed on conveying belt 601.

Registering member 604 swings from the position illustrated with a solid line to the position illustrated with a dotted line in the diagram after the sheets S stop.

After registering member 604 swings, conveying belt 601 moves in the direction indicated by arrow F and stops when stopper claw 603 makes the fold part of the sheets S hit the registering member 604.

In this way, a skew of sheets S from the feeding direction is corrected by making the sheets contact the registering member 604.

After stopper claw 603 stops, fold-holding member 605 lowers in the direction shown by arrow G in the diagram and pinches the sheets S with backing plate 606 which is mounted to have a plane which is substantially the same as sheet loading table 602.

After completion of the pinching of the sheets S, trimming conveyor 600 rotates and the stopper claw 603 is retreated to the position illustrated with dotted lines in the diagram.

After completion of the retreat of stopper claw 603, registering member 604, fold-holding member 605 and backing plate 606 are swung solidly with trimming conveyor 600, while pinching sheets S, around the center of pulley 607 of the trimming conveyor 600, and stopped at the horizontal position indicated in FIG. 6(*b*).

After the swing motion of the trimming conveyor 600 is completed, the sheets S are moved in the direction of arrow H shown in the diagram while sliding on sheet loading table 602, during being pinched by fold-holding member 605 and backing plate 606 which compose inserting means 600A, to be inserted in a trimming process unit having an edge holding member, an edge sustaining member and a lower blade which will be explained later, and stopped at the prescribed position determined according to the size of respective sheets.

The sheets S which stop at the prescribed position have their edges trimmed by trimming apparatus 700, and the trimming mechanism and the edge holding member which is a special feature of the invention will be explained referring to FIG. 7 and FIG. 8.

The numeral 701 represents an edge holding member which is vertically movable, the numeral 702 represents an edge sustaining member fixed to main body sides 700B and 700C, and the numeral 703 represents a lower blade which is vertically movable.

Lower blade receiving member 701A made of resin (polypropylene in the embodiment of the invention) is fixed on the surface of edge holding member 701 which is facing sheets S.

The numerals 704 and 705 represent links and their edges are connected rotatably to edge holding member 701 in the vicinity of both ends of the edge holding member respectively and other edges are connected rotatably to female screw units 706 and 707 respectively.

Female screw units 706 and 707 are engaged with male screw rod 708 on which two male screws are threaded in the opposite directions to one another.

Male screw rod 708 is sustained rotatably by main body side boards 700B and 700C of trimming apparatus 700 and the rotation is transmitted from edge holding motor 709 which is reversible in terms of rotation via plural gears (no reference numbers).

Accordingly, edge holding member 701 moves up and down owing to bidirectional rotation of the edge holding motor 709.

The above-mentioned plural gears are composed to transmit rotation of edge holding motor 709 to male screw rod 708 while they reduce the rotation speed.

By this way, a large torque may be transmitted to male screw rod 708, even though the motor capacity of edge holding motor 709 is small, and sheets S are pinched by edge holding member 701 and edge sustaining member 702 with large force to avoid slipping of the sheets while trimming process is carried out.

The symbol PS1 represents the first opening position detector (first detector) and the symbol PS2 represents the second opening position detector (second detector) which is located on the right side of the first opening position detector in FIG. 7, and these detectors detect the position of female screw unit 706 in the horizontal direction, which means the position of edge sustaining member 702 in the vertical direction.

As it is clearly shown in the diagram, it is composed so that a size of clearance to accept sheets S between edge holding member 701 and edge sustaining member 702, namely opening size K becomes smaller when the female screw unit 706 is detected by the second detector PS2 than by the first detector PS1.

The position of edge holding member 701 when the female screw unit 706 is detected by the first detector PS1 is named first opening position K1, and the position of edge holding member 701 when detected by the second detector PS2 is named second opening position K2.

The first opening position K1 and the second opening position K2 are standby positions of edge holding means 701 when sheets S are inserted into the trimming processing unit, and the standby position is determined according to the number of the sheets to which trimming is applied, which will be explained later.

Lower blade 703 is equipped with two rotatable rollers 715 and 716, and the rollers 715 and 716 are slidably fitted into guide members 717 and 718, which are fixed to the main body of trimming apparatus 700 (no reference number) and the sliding parts of which are formed obliquely to the upper left direction as shown in FIG. 7.

Lower blade 703 has connecting part 703A and roller 719 is installed rotatably to the end of connecting part 703A.

Roller 719 is fitted slidably into guide groove 725A which is formed vertically on lower blade driving member 725 as shown in FIG. 7.

The lower blade driving member 725 is engaged with male screw rods 726 and 727, and male screw rods 726 and 727 are sustained by main body side boards 700B and 700D rotatably, and rotation is transmitted from reversible lower-blade driving motor 728 via plural gears (no reference numbers) so that the directions of rotation of both screws are the same.

Male screw rods 726 and 727 rotate in the same direction and lower blade driving member 725 moves reciprocatively in the direction of arrow Q shown in FIG. 7 by bidirectional rotation of lower blade driving motor 728. Consequently, rollers 715 and 716 move along the sliding parts of guide member 717 and 718, and lower blade 703 shifts straight in the direction formed by the sliding parts, that is, the direction from the upper left to the lower right and vice versa in FIG. 7.

As it is clear by the above explanation, according to the embodiment, shifting means 700A which changes the opening size K to accept sheets S by changing the relative position between edge holding member 701 and edge sustaining member 702, includes links 704 and 705, female screw units 706 and 707, male screw rod 708 and edge holding motor 709.

In order to make opening size K variable, there can be considered other method which is, for example, composing the mechanism so that edge holding member 701 and edge sustaining member 702 are moved in the opposite directions simultaneously, and employing this kind of structure has an advantage to reduce time for changing the opening size.

An explanation will be given referring to FIG. 8, regarding the movement of trimming apparatus 700 which is structured as described above.

Sheets S which have finished a center-folding process and a saddle-stitching process, slides on sheet loading table 602 and travels in the direction of arrow H shown in FIG. 8, being pinched by fold-holding member 605 and backing plate 606, to be inserted in a trimming process section which has edge holding member 701, edge sustaining member 702 and lower blade 703, and then sheets stop at the prescribed position determined according to the size of respective sheets.

When the sheets S stop, edge holding motor 709 (refer to FIG. 7) rotates and edge holding member 701 which has stood by at the first opening position K1 or the second opening position K2 lowers a distance corresponding to the number of the sheets, and pinches the sheets S with edge sustaining member 702 at the position near the edge.

When the sheets S are pinched, lower blade driving motor 728 (refer to FIG. 7) starts to rotate and lower blade 703 rises in an oblique direction to the upper left in FIG. 7 until the edge of the blade cuts into slightly in the lower blade receiving member 701A and carries out edge trimming of the sheets S.

After completion of the edge trimming, lower blade driving motor 728 rotates reversely and lower blade 703 lowers in an oblique direction to the prescribed position on the lower right in FIG. 7.

After completion of the lowering motion of the lower blade 703, edge holding member 701 rises to the first opening position K1 or the second opening position K2.

After completion of the rising motion of the edge holding member 701, when fold-holding member 605 and backing plate 606 which have held the vicinity of the fold of the sheets S return to the positions indicated in FIG. 6 (*b*), fold holding member 605 rises and registering member 604 is retreated downward under a sheet conveying plane and the sheets S are released from the pinch.

Next, trimming conveyor 600 rotates, and the sheets, the edge of which has been trimmed, are dropped by stopper claw 603 in the direction indicated by a arrow from the end of the trimming conveyor 600 and conveyed by rotating collecting conveyor 800 as shown in FIG. 4, and then, discharged into paper discharge tray 850 arranged on the front side of the post-processing apparatus B.

After a series of the operation mentioned above, the edge trimming process of sheets S is completed.

Next, an explanation will be given, referring to FIG. 9 and FIG. 10, regarding control method and control procedure which change opening size K between edge holding member 701 and edge sustaining member 702 according to the number of the sheets S to be trimmed.

Figure 9:
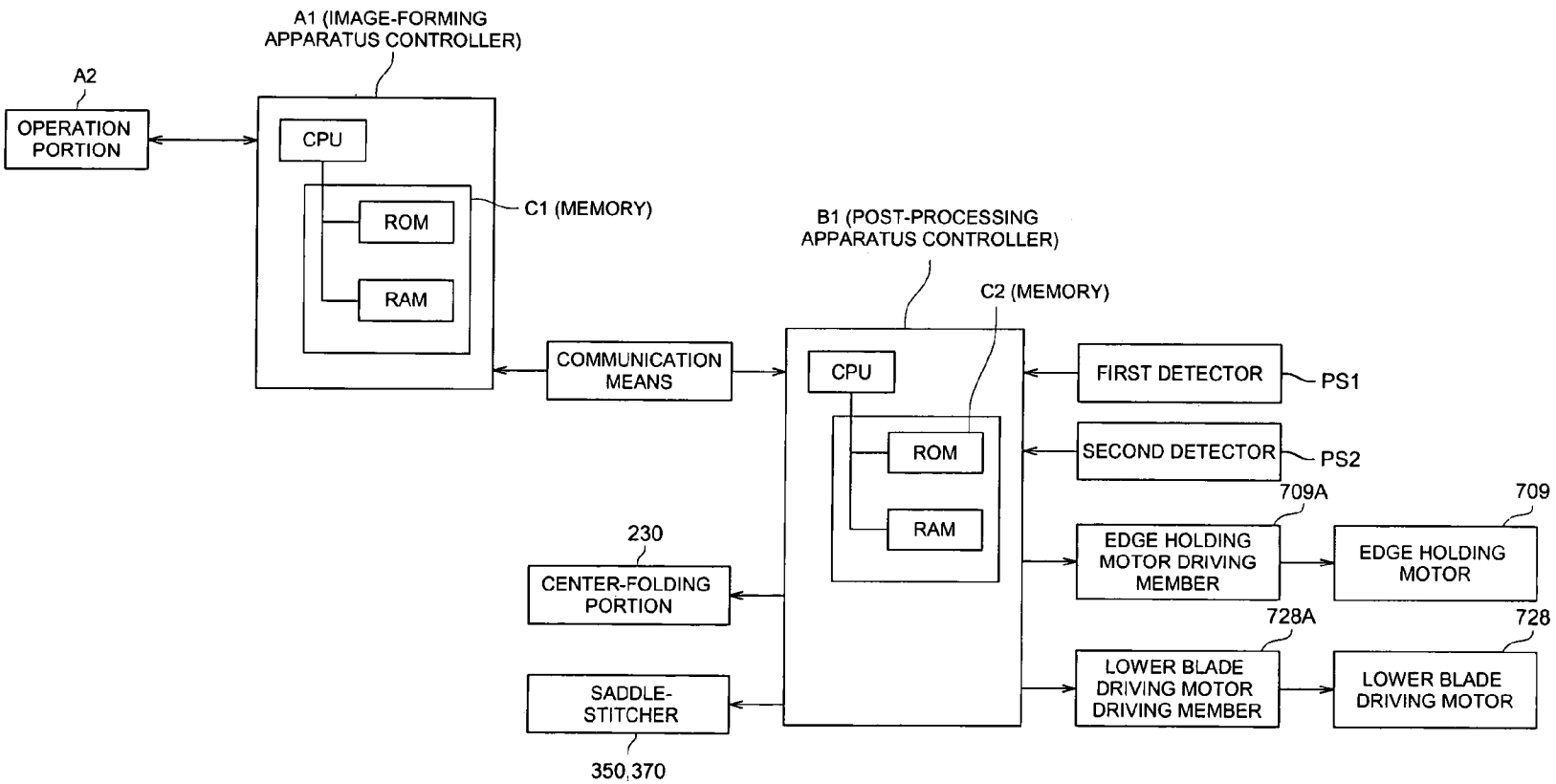
FIG. 9 is a block diagram of control for image-forming apparatus A and post-processing apparatus B.
Figure 10:
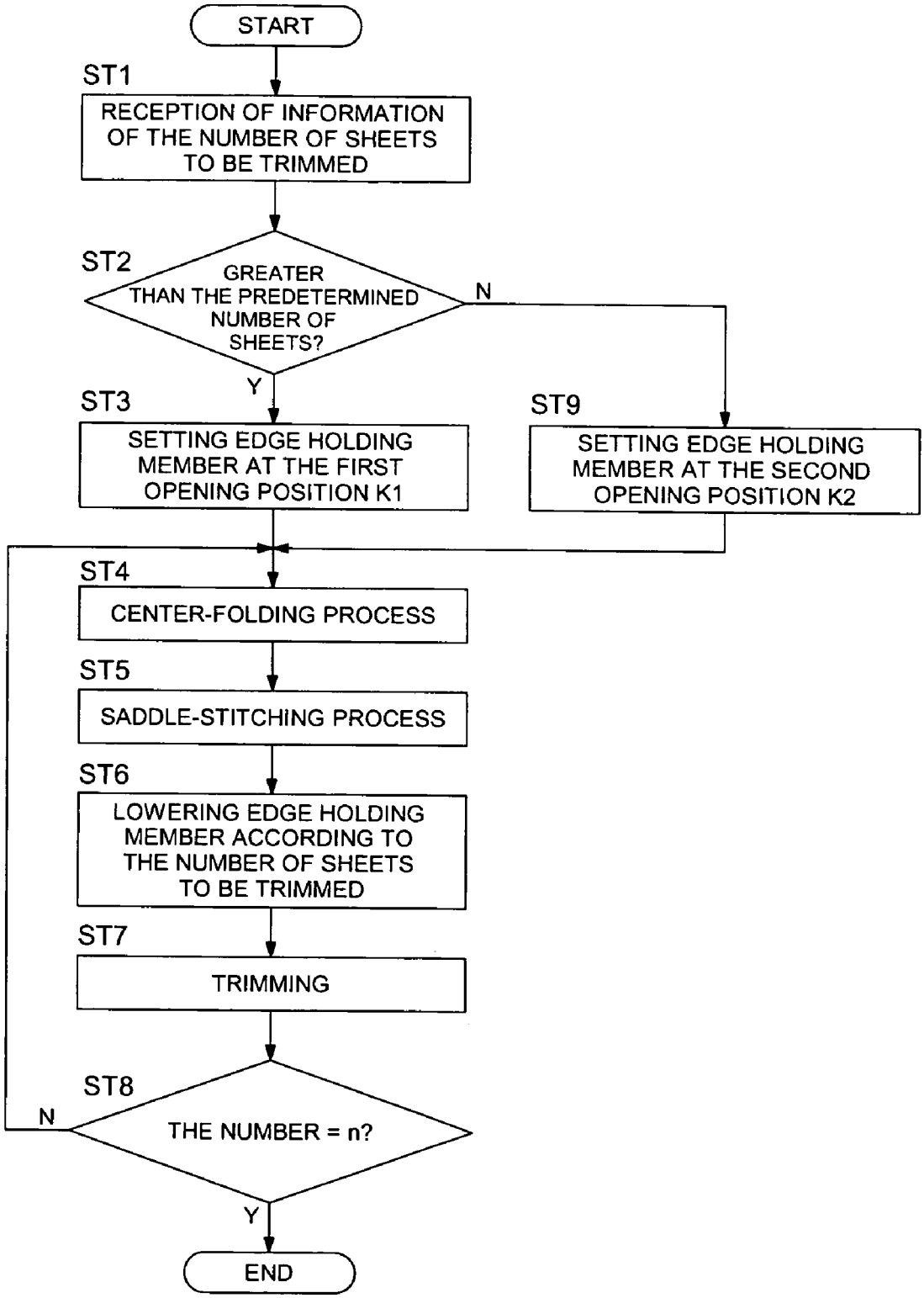
FIG. 10 is a flowchart showing control procedures for center-folding, saddle-stitching, edge trimming.
Figure 11:
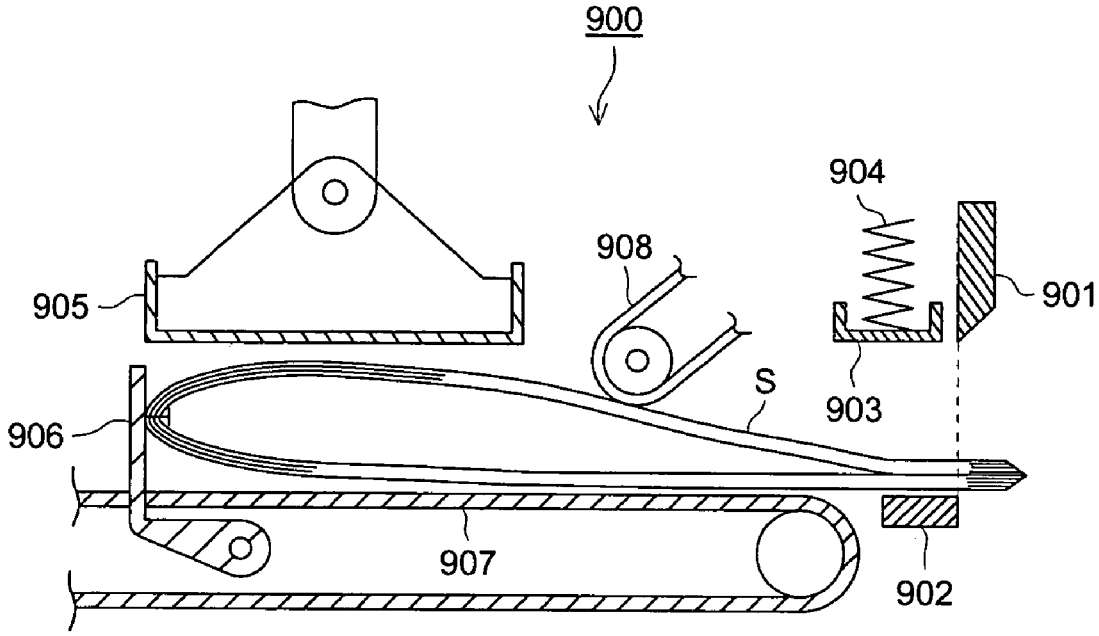
FIG. 11 is a cross-sectional view of main parts of a conventional trimming apparatus.

FIG. 9 is a block diagram of control of image-forming apparatus A and post-processing apparatus B, and FIG. 10 is a flowchart showing a control procedure of the post-processing apparatus for center-folding, saddle-stitching and edge trimming applied to sheets fed from the image-forming apparatus.

First, an explanation will be given regarding to the control structure referring to FIG. 9.

Image-forming apparatus controller A1 includes CPU performing various kinds of control procedures, memory C1 (ROM and RAM) storing control procedures and various kinds of data.

Operation portion A2 includes a ten-key board and a liquid crystal display means, and there are inputted, input signals of the number of copy, start signals of image formation, selection signals for center-folding, saddle-stitching and edge trimming to image-forming apparatus controller A1 by operation portion A2.

Post-processing controller B1 includes CPU performing various kinds of control procedures and memory C2 (ROM and RAM) storing data such as time for the lowering motion of the edge holding member according to the control procedures and the number of sheets to be trimmed, and carries out a total control of post-processing apparatus including reception of detection signals from the first detector PS1 and the second detector PS2, and a saddle-stitcher having center-folding means 230, stapler 350 and staple receiving means 370, and driving source for edge holding motor driving member 709A and driving source for lower blade driving motor driving member 728A.

A controller for edge holding motor 709 which lowers edge holding member from the first opening position K1 or the second opening position K2, according to the number of sheets to be trimmed, is included in post-processing apparatus controller B1.

Image-forming apparatus controller A1 and post-processing apparatus controller B1 are combined to be intercommunicable.

In the embodiment of the invention, though the controller is separated into image-forming apparatus controller A1 and post-processing apparatus controller B1, it is also possible that one controller, for example, image-forming apparatus controller A1 carries out whole control of the image-forming apparatus and the post-processing apparatus.

Next, a control procedure for center-folding, saddle-stitching and trimming will be explained referring to FIG. 10.

First, post-processing apparatus controller B1 receives information of the number of sheets to be trimmed from image-forming apparatus controller A1 (ST1).

Next, post-processing apparatus controller B1 judges whether the number of sheets to be trimmed is greater than the predetermined number (ST2), and when the number is greater than the predetermined number (ST2; Y), it drives edge holding motor 709 to move edge holding member 701 to the position where the first detector PS1 detects female screw unit 706 to set the edge holding member 701 at the first opening position K1.

After center-folding process (ST4) and saddle-stitching process (ST5), edge holding member 701 is lowered for the time corresponding to the number of sheets to be trimmed, which has been stored in memory C2 of post-processing controller B1 (ST6) and pinches a vicinity of edge of the sheets S.

After completion of lowering motion of edge holding member 701, lower blade driving motor 728 is driven and trimming is carried out (ST7), and then, it is judged whether or not the number of trimmed sheets has reached the designated number (n) (ST8), and if it has not (ST8; N), the subsequent step returns to be ST4 and the procedure described above is repeated until it reaches the prescribed number.

At step ST2, if the number of sheets to be trimmed is less than the predetermined number (ST2; N), edge holding motor 709 is driven to move the edge holding member 701 to the position where the second detector PS2 detects female screw unit 706 to set edge holding member 701 at the second opening position K2 (ST9).

After completion of the setting, the aforementioned steps of motion ST4 through ST8 are carried out.

As explained above, by changing a opening size between edge holding member and edge sustaining member according to the number of sheets to be trimmed, optimization, namely shortening of the time which is necessary to hold the vicinity of the edge of sheets becomes possible, and decline of the productivity can be prevented because no waiting time is produced in the image-forming apparatus or in the post-processing apparatus even when only a small number of sheets are treated.

In the embodiment of the invention, though the number of standby positions of the edge holding member is assumed to be two, it is not limited to this, and for example, it is possible to set the number of the aforementioned standby positions to be more than two according to the number of sheets to be trimmed.

According to the embodiment, reduction of productivity can be prevented with a simple structure and control, by making the edge holding member stand by at the first opening position if the number of the sheets to be trimmed is greater than the predetermined number, and stand by at the second opening position closer to the edge sustaining member than the first opening position if the number is less than the predetermined number, when sheets are inserted into a trimming process section of the trimming apparatus.

According to the embodiment, it is possible to obtain an image-forming apparatus equipped with a post-processing apparatus having a trimming apparatus which does not cause reduction of the productivity.

This invention has been described above with reference to the aforementioned embodiment. It is evident, however, that many alternative modifications and variations will be apparent to those having skill in the art in light of the foregoing description. Accordingly, the present invention embraces all such alternative modifications and variations as fall within the spirit and scope of the appended claims.

What is claimed is:

1. A post-processing apparatus equipped with a trimming apparatus, which carries out a trimming process on an edge of a bundle of sheets, comprising, an inserting mechanism which inserts the bundle of sheets into a trimming process section of the trimming apparatus, an edge holding member and an edge sustaining member which pinch a vicinity of the edge of the bundle of sheets inserted into the trimming process section, a shifting mechanism which changes a relative position between the edge holding member and the edge sustaining member and makes an opening size between the edge holding member and the edge sustaining member variable before a pinching motion, and a controller for receiving information about the number of sheets composing the bundle of sheets from an image forming apparatus;

said controller which controls the shifting mechanism to adjust the opening size depending on the number of sheets composing the bundle of sheets to be trimmed so as to make at least one of the edge holding member and the edge sustaining member stand by while maintaining the opening size before starting of a pinching motion thereof and before the bundle of sheets is inserted into the trimming process section by the inserting mechanism.

2. The post-processing apparatus of claim 1, wherein the controller makes the edge holding member stand by at a first opening position when the number of sheets composing the bundle of sheets to be trimmed is greater than a predetermined number, and then, makes the edge holding member stand by at a second opening position closer to the edge sustaining member than the first opening position when the number of the sheets is not greater than the predetermined number, and controls the shifting mechanism to move the edge holding member toward the edge sustaining member from each of the opening positions to pinch the bundle of sheets before the trimming process.

3. The post-processing apparatus of claim 2 comprising a first detector which detects that the edge holding member is located at the first opening position and a second detector which detects that the edge holding member is located at the second opening position.

4. The post-processing apparatus of claim 1, wherein the shifting mechanism is comprised to allow both the edge holding member and the edge sustaining member to be movable.

5. An image-forming apparatus which is equipped with an image-forming portion to form an image on a sheet and has the post-processing apparatus of claim 1.

6. The image-forming apparatus of claim 5, wherein the controller of the post-processing apparatus controls the shifting mechanism based on information regarding the number of sheets to be trimmed, transmitted from an image-forming apparatus controller installed in the image-forming apparatus.

* * * * *